US008066816B2

(12) United States Patent
Asplund et al.

(10) Patent No.: US 8,066,816 B2
(45) Date of Patent: Nov. 29, 2011

(54) PROBE CLEANING METHOD AND APPARATUS

(75) Inventors: Peter Asplund, Hässelby (SE); Carl-Johan Hjerpe, Nacka (SE)

(73) Assignee: Pratt & Whitney Line Maintenance Services, Inc., Hartford, CT (US)

( * ) Notice: Subject to any disclaimer, the term of this patent is extended or adjusted under 35 U.S.C. 154(b) by 650 days.

(21) Appl. No.: 11/793,443

(22) PCT Filed: Jan. 25, 2005

(86) PCT No.: PCT/SE2005/000072

§ 371 (c)(1), (2), (4) Date: Sep. 17, 2007

(87) PCT Pub. No.: WO2006/080868

PCT Pub. Date: Aug. 3, 2006

(65) Prior Publication Data

US 2008/0156898 A1 Jul. 3, 2008

(51) Int. Cl.
*B08B 9/00* (2006.01)

(52) U.S. Cl. ..... 134/22.1; 134/34; 134/25.1; 239/106

(58) Field of Classification Search ..... 239/106; 134/22.1, 22.12, 22.13, 22.14, 22.18, 22.19, 134/34

See application file for complete search history.

(56) References Cited

U.S. PATENT DOCUMENTS 3,385,522 A * 5/1968 Kock ..... 239/104
3,546,084 A * 12/1970 Dohogne et al. ..... 205/710
3,623,668 A * 11/1971 Freid et al. ..... 239/265.17
4,196,020 A * 4/1980 Hornak et al. ..... 134/167 R
4,378,755 A * 4/1983 Magnusson et al. ..... 118/684
4,559,664 A * 12/1985 Bohme et al. ..... 15/302
4,872,807 A * 10/1989 Thompson ..... 415/118
4,995,915 A * 2/1991 Sewell et al. ..... 134/22.14
5,011,540 A * 4/1991 McDermott ..... 134/23
5,193,976 A 3/1993 Kolev et al.
5,273,395 A * 12/1993 McDermott ..... 415/121.3
5,281,091 A * 1/1994 Dooley et al. ..... 415/178
5,318,254 A 6/1994 Shaw et al. ..... 244/134
5,458,299 A * 10/1995 Collins et al. ..... 244/134 C
5,867,977 A * 2/1999 Zachary et al. ..... 60/39.53
5,899,217 A 5/1999 Testman, Jr. ..... 134/104.4
5,944,483 A 8/1999 Beck et al.
6,451,126 B1 * 9/2002 Mattix ..... 134/36
6,553,768 B1 * 4/2003 Trewin et al. ..... 60/772
6,817,475 B2 * 11/2004 Jacobson et al. ..... 210/409

(Continued)

FOREIGN PATENT DOCUMENTS

DE G 94 20 362.8 3/1995

(Continued)

*Primary Examiner* — Michael Kornakov
*Assistant Examiner* — Katelyn Whatley
(74) *Attorney, Agent, or Firm* — Kinney & Lange, P.A.

(57) ABSTRACT

A cleaning apparatus for cleaning measuring probes (18) of a gas turbine engine (1). The invention further relates to a method for cleaning measuring probes (18) of an gas turbine engine (1). The apparatus comprises distribution means (30) comprising a plurality of supply means (31, 32, 33), each comprising connection means (33) arranged for connection to a probe (18), and each supply means (31, 32, 33) being arranged to, when connected to a probe (18), distribute pressurized cleaning liquid to said measuring probe (18), wherein a substantially simultaneous cleaning of probes connected to said distribution means (30) via said supply means (31, 32, 33) can be obtained.

11 Claims, 3 Drawing Sheets

U.S. PATENT DOCUMENTS

| | | | | |
|---|---|---|---|---|
| 7,275,550 | B2 * | 10/2007 | Nealon | 134/22.1 |
| 7,353,654 | B2 * | 4/2008 | Bolis et al. | 60/775 |
| 7,484,407 | B2 * | 2/2009 | Arlt et al. | 73/114.75 |
| 7,526,920 | B2 * | 5/2009 | Hoffmann et al. | 60/775 |
| 7,712,301 | B1 * | 5/2010 | Wagner | 60/39.53 |
| 2001/0039794 | A1 * | 11/2001 | Rocklin et al. | 60/39.05 |
| 2002/0100495 | A1 * | 8/2002 | Bexten et al. | 134/18 |
| 2002/0141882 | A1 * | 10/2002 | Ingistov et al. | 417/244 |
| 2003/0047198 | A1 * | 3/2003 | Fargnoli | 134/22.18 |
| 2003/0209256 | A1 | 11/2003 | Tadayon | 134/10 |
| 2004/0007245 | A1 * | 1/2004 | Hecht et al. | 134/1 |
| 2006/0048796 | A1 * | 3/2006 | Asplund et al. | 134/21 |
| 2007/0059159 | A1 * | 3/2007 | Hjerpe | 415/117 |
| 2007/0095364 | A1 * | 5/2007 | Watt | 134/10 |
| 2008/0102292 | A1 * | 5/2008 | Vontell et al. | 428/457 |

FOREIGN PATENT DOCUMENTS

| | | |
|---|---|---|
| EP | 0 628 477 | 12/1994 |
| WO | WO 2004/055334 A1 | 7/2004 |

* cited by examiner

PROBE CLEANING METHOD AND APPARATUS

RELATED APPLICATION

This is a §371 of International Application No. PCT/SE2005/000072, with an international filing date of Jan. 25, 2005 (WO 2006/080868, published Aug. 3, 2006), incorporated herein by reference.

TECHNICAL FIELD

The present invention relates to the field of cleaning gas turbine engines installed onboard aircraft, and more specifically a method and apparatus for cleaning a set of measuring probes for engine pressure ratio indication (EPR Indicator) of such gas turbine engines.

BACKGROUND OF THE INVENTION

A gas turbine aircraft engine comprises of a compressor compressing ambient air, a combustor burning fuel together with the compressed air and a turbine for powering the compressor. The expanding combustion gases drive the turbine and also result in thrust for propelling the aircraft.

A gas turbine aircraft engine is equipped with various sensors for measuring the performance of the engine. One of many parameters measured is the engine pressure ratio (EPR). The EPR is a widely used parameter used for engine thrust settling. EPR is derived from gas pressure sensors installed in the engines gas path. One typical installation of EPR sensors is immediately downstream of the last stage of the turbine. In this position, the sensors are exposed to the exhaust gases of the engine. Exhaust gases comprises air and combustion products. Specifically, the exhaust gases contain particles in form of un-combusted fuel and combustion products such as coke and ash. Further the exhaust gases contain air foreign particles. Small particles have the ability to find their way into cavities of objects in the gas path such as the air passage of the probe for pressure measurement used in EPR estimates. Particles entering the probe may partially block the air passage and thereby restrict the air flow. Particles entering the probe may totally block the passage to the sensors. A partially blocked or totally blocked passage results in a false pressure indication or no pressure indication at all. To restore the probe to prime working condition, the aircraft maintenance procedure calls for dismantling the probe from the engine and have it cleaned or replaced with a replacement probe. This is a time consuming and costly operation due to the fact that there are multiple of these probes on each engine and in case of improper instrument reading all probes will have to be removed and cleaned.

In actual aircraft installations there are multiple probes. Each one is connected via a conduit to a manifold which in turn is connected to a pressure sensing device. The pressure sensing device generates a signal to a pressure ratio transmitter which in turn delivers a signal to the EPR instrument. The use of multiple probes allows for one or a portion of the probes being blocked without giving a false EPR reading. However, when instable EPR instrument readings are observed it is often an indication that probes are blocked.

According to aircraft maintenance routines a blocked probe is put into service again by a replacement probe or by cleaning the blocked probe. Cleaning may be the preferred action for reason of saving costs as the same probe is used again. Cleaning is conducted by dismantling the probe from the engine and cleaning according to a cleaning procedure.

Consequently, there is a great need of a method and an apparatus that provides for an efficient, both in terms of cleaning efficiency and time consumption, and cost-saving cleaning of a set of measuring probes of a gas turbine engine of an aircraft.

SUMMARY OF THE INVENTION

Thus, an object of the present invention is to provide a method and an apparatus that enables an efficient, both in terms of cleaning efficiency and time consumption, and cost-saving cleaning of a set of measuring probes of a gas turbine engine of an aircraft. This and other objects are achieved according to the present invention by providing a method and an apparatus having the features of the independent claims. Preferred embodiments are defined in the dependent claims.

For purposes of clarity, engine pressure ratio (EPR) is a widely used parameter used for monitoring engine performance. EPR is derived from measuring the air pressure by sensors installed in the engines gas path. A first measuring point used for EPR estimates is immediately downstream of the last stage of the turbine. A second measuring point is immediately upstream of the compressor inlet of the engine.

According to an aspect of the present invention, there is provided an apparatus for cleaning measuring probes of an gas turbine engine. The apparatus comprises distribution means comprising a plurality of supply means, each comprising connection means arranged for connection to a probe, and each supply means being arranged to, when connected to a probe, distribute pressurized cleaning liquid to the measuring probe, wherein a substantially simultaneous cleaning of probes connected to the distribution means via the supply means can be obtained.

According to second aspect of the present invention, there is provided a method for cleaning for cleaning measuring probes of an gas turbine engine. The method comprises the step of distributing pressurized cleaning liquid to said probes by means of a plurality of supply means, each comprising connection means arranged for connection to a probe, and each being arranged to, when connected to a probe, distribute pressurized cleaning liquid to the measuring probe, wherein a substantially simultaneous cleaning of probes connected to the distribution means can be obtained.

The present invention is based on the idea of use of a distributor with individual flow lines connectable to individual probes. Thereby, the individual probes can be cleaned substantially simultaneously by injecting a wash liquid at high pressure whereby foreign particles are released and removed out of the probes thereby clearing the air passage of the probes. This is an advantage compared to the conventional engine maintenance routines where it is necessary to clean each of the EPR pressure measurement probes individually and individually confirm that the air passage is clear.

Another advantage is that the cleaning the EPR pressure measurement probes can be done without dismantling the probes from the engine, which is an improvement compared to established routines. Thereby, the time consuming and costly operation of dismantling the probes can be avoided Accordingly, this invention significantly reduces the time and costs for cleaning of blocked probes.

BRIEF DESCRIPTION OF THE DRAWINGS

The invention will now be described in greater detail with reference to the accompanying drawings, in which.

DESCRIPTION OF PREFERRED EMBODIMENTS

The invention disclosed herein is exemplified by its application on a single shaft turbofan engine. The invention is equally applicable to other gas turbine engines although not shown here. The description below relates to an example installation for a typical single shaft turbofan engine. Anyone skilled in the art can practice the invention on other types of engine installations and yet be within the scope of this invention.

Figure 1:
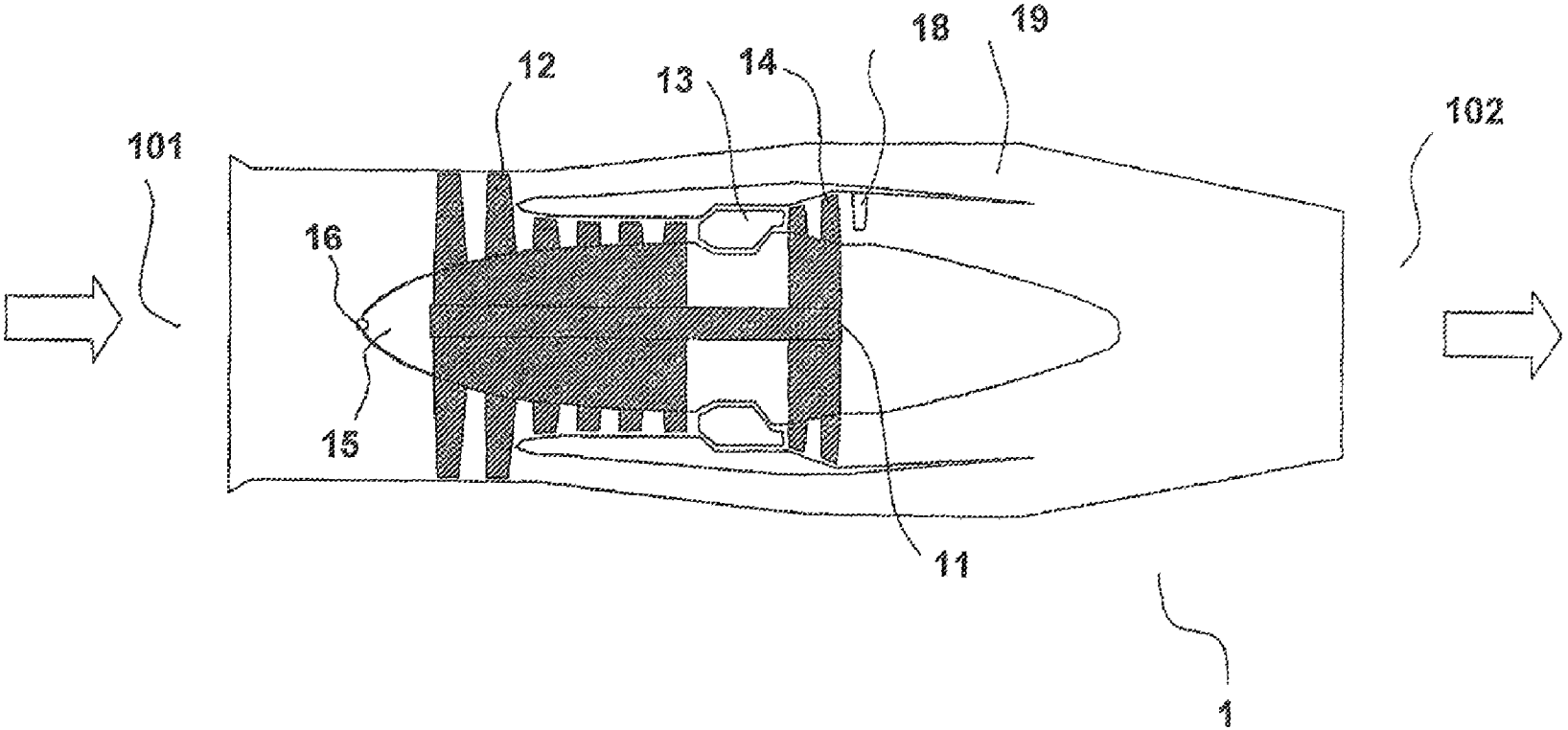
Fig. 1 Prior Art
FIG. 1 shows the cross section of a single shaft turbofan engine.

A cross section view of a single shaft turbofan engine is shown in FIG. 1. Arrows show the direction of mass flow through the engine. Engine 1 comprises of a rotor shaft 11 which at its front end is connected a compressor 12 and at its rear end a turbine 14. Engine 1 has an inlet 101 where inlet air enters the engine. One portion of the inlet air is partially compresses by compressor 12 and further routed through the engine via duct 19. The remaining portion of the inlet air is fully compressed by compressor 12 and is routed to combustor 13. The compressed air together with fuel (not shown) is combusted in combustor 13 resulting in pressurized hot combustion gases. The pressurized hot combustion gases expand towards engine outlet 102 while driving turbine 14.

As mentioned above, engine pressure ratio (EPR) is a widely used parameter used for monitoring engine performance. EPR is derived from measuring the air pressure by sensors installed in the engines gas path. A first measuring point used for EPR estimates is immediately downstream of the last stage of the turbine. A second measuring point is immediately upstream of the compressor inlet.

Now referring to FIG. 1, probe 18 is one of multiple identical probes used for EPR estimates. Probe 18 is installed in the gas path downstream of the turbine. Probe 18 is connected (not shown) to a pressure measuring sensor (not shown) for measuring the total gas pressure. This is the first measuring point. The front of compressor 12 comprises of a cone 15 for splitting the airflow. Cone 15 is not rotating. At the tip of cone 15 is an opening 16 connected to a pressure measuring sensor (not shown) for measuring the total air pressure. This is the second measuring point. EPR is then estimated as the ratio between the pressure readings of the first and second measuring points whereby the first measuring point is the nominator and the second measuring point is the denominator.

This invention relates to an improved method for cleaning of probe 18 whose air passage has been blocked by foreign particles. Cleaning is accomplished with the use of an apparatus temporarily placed adjacent to the aircraft's engine. The apparatus comprises of a high pressure liquid pump and a distributor for distributing a wash liquid to each of probe 18.

By forcing a cleaning fluid through the air passage of probe 18, foreign particles are released and removed. The cleaning mechanism is accomplished by the mechanical movement and or chemical act of the cleaning liquid. The leaning liquid may be composed of water or heated water, with or without chemicals. Alternatively may the cleaning liquid be composed of only chemicals.

By forcing a cleaning liquid by high pressure through the air passage of probe 18, a high velocity is accomplished as the liquid's high pressure expands to ambient pressure. The high liquid velocity result in high shear forces on the surface of the air passage of probe 18. The high shear forces enhance the removal of foreign particles.

The invention disclosed herein describes an apparatus comprising of a distributor for individual distribution of wash liquid to probes 18. Liquid is distributed to the probes via flex hoses where each flow is controlled by a valve. Further the apparatus is equipped with a flow meter. By opening one valve a corresponding probe is washed. The washing result is monitored by reading the flow rate value of the flow meter. A high flow rate indicates the air passage of the probe is free from foreign particles. A low flow rate indicates the that the probe is partially blocked. No flow rate at all would indicate that the probe is totally blocked. After having washed one probe washing of the next probe takes place. This is a quick and cost reducing procedure compared to prior art procedures. It is the purpose of this invention to reduce the time and costs for EPR probe cleaning.

By the use of the distributor and flow meter, the operator can by simple hand operation of the valves on the distributor clean all probes and simultaneously verify that the passage is cleared by reading the liquid flow from the flow meter. The probe that records the highest flow rate would then be the base for the very most cleaned probe. The flow rate recorded by the other probes is then compared with the very most cleaned probe. Any significant deviation would indicate that the probe is still blocked. It is the purpose of this invention to provide a method for cleaning of EPR probes and confirm the cleaning result.

Figure 2:
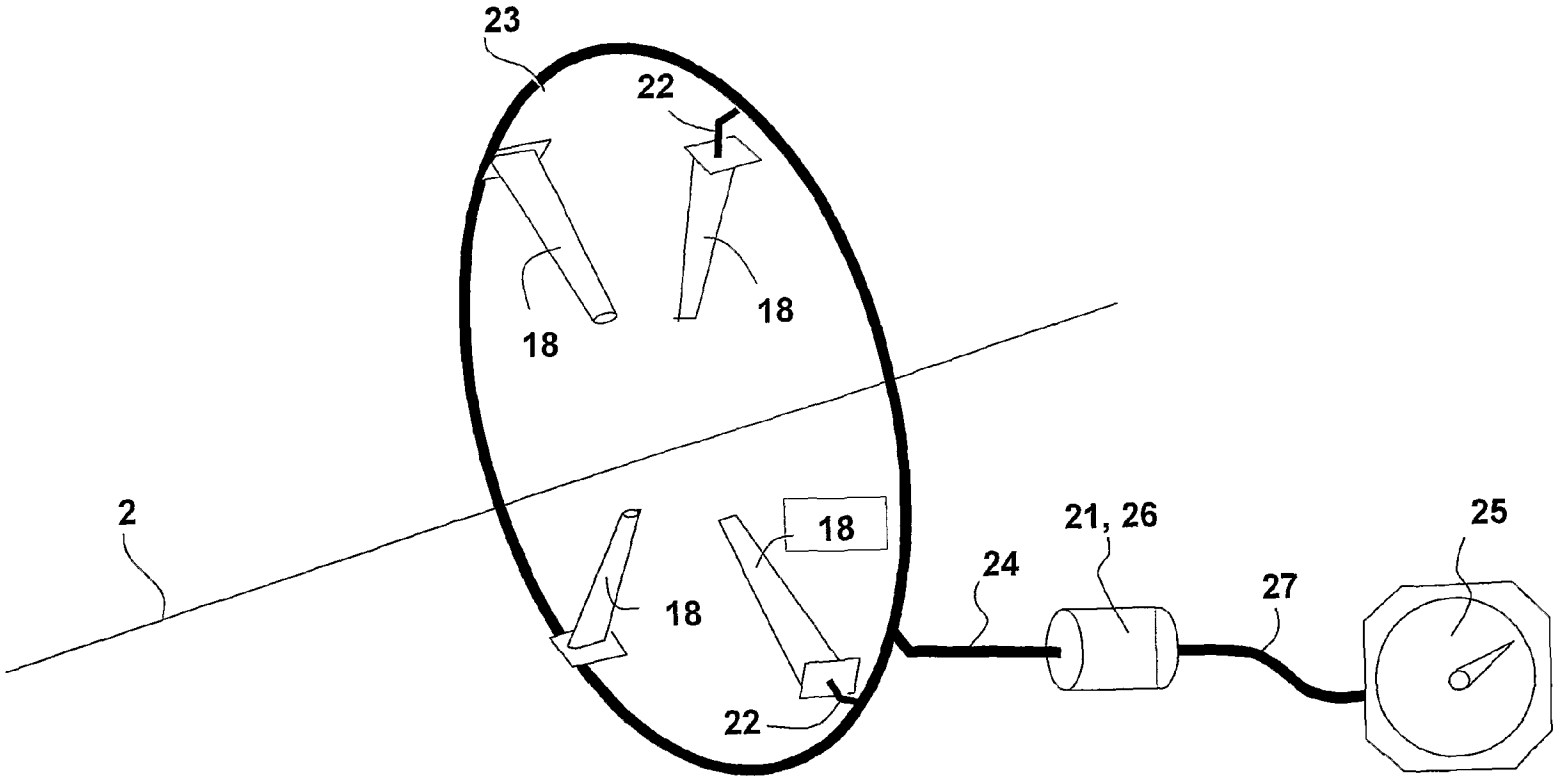
FIG. 2 shows EPR probes and their connection to the EPR instrument.

FIG. 2 shows the typical arrangement of probe 18 and its connection to EPR instrumentation. FIG. 2 shows a perspective view of four probe 18. Probes 18 are positioned in the gas path symmetrically around engine shaft centre 2 and downstream of the turbine. Probe 18 has an air channel connected to conduit 22. Conduit 22 is further connected to manifold 23. Conduit 24 connects manifold 23 to a pressure sensing device 21 and pressure ratio transmitter 26. Signal 27 is further connected to EPR instrument 25. A signal (not shown) similar to signal 24 deriving from the second pressure measuring point 16 at the tip of inlet cone 15 is connected to a pressure sensing device (not shown) and further to pressure ratio transmitter 26 where the two signals computes the EPR instrument signal.

Figure 3:
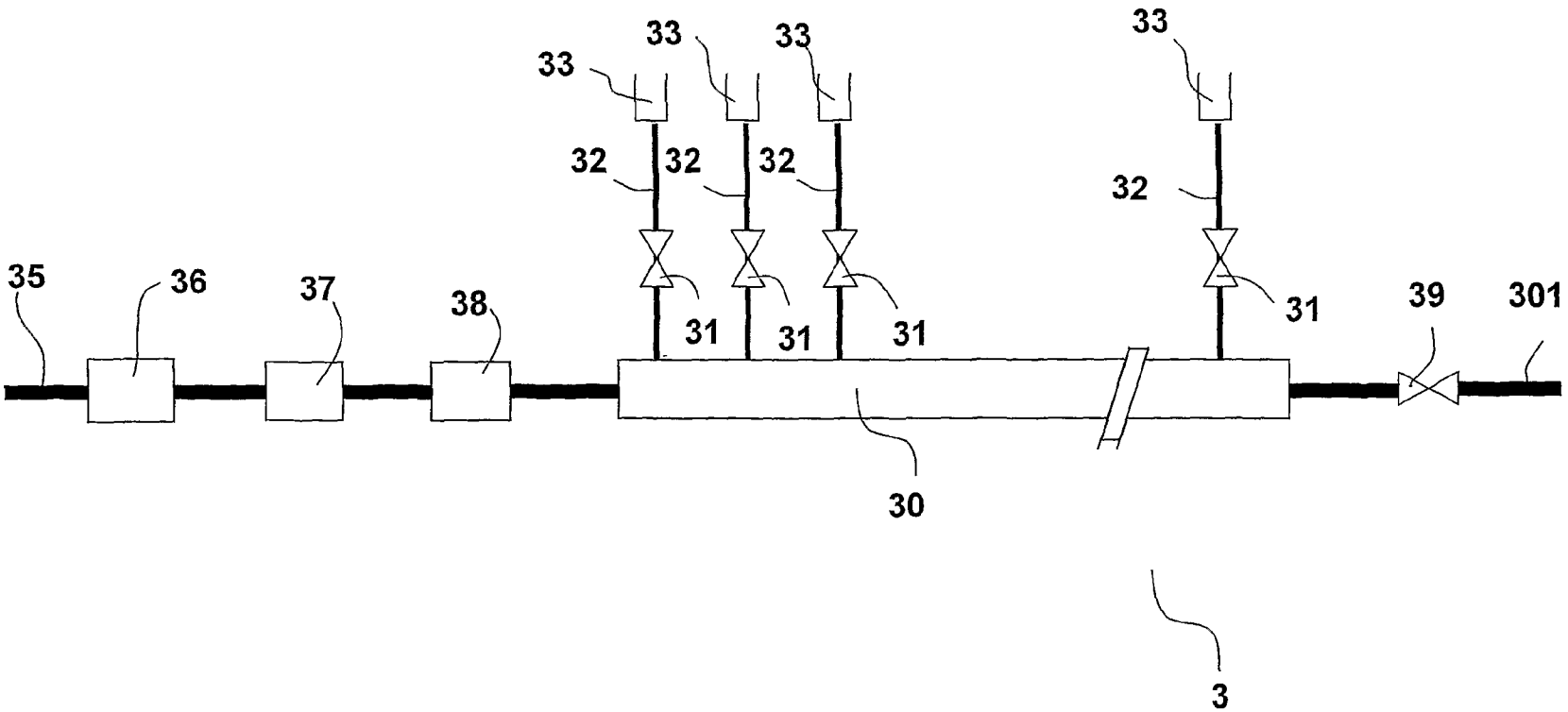
FIG. 3 shows the hardware used for practicing the invention.

FIG. 3 shows an apparatus for cleaning of probe 18. The apparatus allows for cleaning of probes 18 without dismantling the probes from the engine. The apparatus allows for cleaning of probes 18 by simple hand operation by an operator. A distributor 3 comprises of a distributor body 30 with supply means including valves 31 for controlling liquid flow from distributor body 30 to conduit 32. Conduit 32 comprises of a high pressure flexible hose of a defined length. At the end of conduit 32 a connector 33 allows for connection of the conduit to conduit 22 shown in FIG. 2.

The apparatus described in FIG. 3 may be installed on a cart (not shown) for easy mobility.

In operation, a liquid is pumped to distributor body 30. A liquid source (not shown) is connected to pump 36 via conduit 35. The pump raises the liquid pressure to a pressure sufficient for cleaning the air passage of probe 18. Downstream of pump 36 a pressure regulating valve 37 controls the pump pressure. Downstream of pressure regulating valve 37 is a flow meter 38. The flow meter allows for reading the liquid flow rate. A conduit connects the flow meter with distributor body 30. According to an alternative embodiment, a flow meter is arranged in each supply means, between valve 31 and distributor body 30. According to another embodiment, the flow meter 38 may be replaced with a pressure meter as the flow rate is essentially inverse proportional with the pressure.

Compressed air from a compressed air source (not shown) is fed via conduit 301 to valve 39. Valve 39 is further connected by a conduit to distributor body 30. The purpose of the compressed air is to enable purging of conduits and probes after completion of the cleaning operation. This is to ensure no liquid remains in the air passage of probe 18 as any liquid transferred to pressure sensing device 21 could be detrimental to the sensor. Valve 39 is closed during cleaning operation.

The cleaning operation is best understood by referring to FIG. 2 and FIG. 3. On the engine conduit 22 is disconnected from manifold 23 for each of probes 18. Now coupling 33 of one of hose 32 is connected to conduit 22 of one of probe 18. Then coupling 33 of next hose 32 is connected to conduit 22 of next probe 18, and so on unit all probes 18 are connected to the distributor. By starting pump 36 high pressure liquid is fed to distributor body 30. The liquid pressure is set by the pressure regulating valve 37 to typically 40 bar. The cleaning procedure begins by opening one of valves 31 whereby high pressure liquid is fed through hose 32 via coupling 33 through conduit 22 and further through the air passage of probe 18. When a satisfactory liquid flow rate is recorded on flow meter 38, the probe is considered cleaned. Valve 31 is then closed. This procedure is then repeated for each valve connected to each probe 18.

The recorded flow rates from the probes are compared with each other. If some probes are showing a significantly lower flow rate than other probes, the cleaning procedure will be repeated as an attempt of improving the cleaning.

The operating pressure of pump 36 is more than 10 bar preferably more than 40 bar and preferably 70 bar.

The temperature of the wash liquid is as provided by the liquid source or preferably heated to 40 degrees Celsius, or more preferably heated to 60 degrees Celsius.

Each hose 32 has the same length. Each hose 32 comprises of the identical mechanical components and assembly as to provide identical internal flow restrictions and pressure drops. This enables the recorded flows to be compared on an equal basis.

After completion of the cleaning operation pump 36 is stopped. All valves 31 are then opened. The conduits are purged with dry air by opening valve 39 whereby any liquid in the conduits and air passage of probes 18 is blown out.

Finally, the engine is restored for flight operation by disconnecting coupling 33 from conduit 22 and connecting conduit 22 to manifold 23. Although specific embodiments have been shown and described herein for purposes of illustration and exemplification, it is understood by those of ordinary skill in the art that the specific embodiments shown and described may be substituted for a wide variety of alternative and/or equivalent implementations without departing from the scope of the present invention. Those of ordinary skill in the art will readily appreciate that the present invention could be implemented in a wide variety of embodiments. This application is intended to cover any adaptations or variations of the preferred embodiments discussed herein. Consequently, the present invention is defined by the wordings of the appended claims and equivalents thereof.

The invention claimed is:

1. A method for cleaning air passages in a plurality of measuring probes of a gas turbine engine, the method comprising:

disconnecting the plurality of measuring probes from sensors that communicate with the air passages of the measuring probes;

connecting a plurality of hoses to the plurality of probes so that each hose is connected to an air passage of one of the measuring probes;

distributing pressurized cleaning liquid through the hoses to the air passages in the plurality of probes;

independently controlling the flow rate of the pressurized claining liquid through each hose and the air passage connected to that hose;

disconnecting the hoses from the measuring probes after the air passages are cleaned by the flow of cleaning liquid through the air passages; and reconnecting the measuring probes to the sensors.

2. The method of claim 1, and further comprising the step of:

applying a pressure to the cleaning liquid supplied to the probes through the hoses with a pump.

3. The method of claim 2, wherein the step of applying a pressure of the cleaning liquid comprises the step of:

setting the pressure of the cleaning liquid to 40 bar.

4. The method of claim 2, wherein the operating pressure of the pump is at least one of: more than 10 bar, more than 40 bar and more than 70 bar.

5. The method of claim 1, and further comprising the step of:

independently measuring the liquid flow rate of the liquid distributed to each of the probes.

6. The method of claim 1, and further comprising the step of:

regulating the pressure of the cleaning liquid to a predetermined value.

7. The method of claim 1, and further comprising the step of:

independently measuring the pressure of the cleaning liquid distributed to each of the probes.

8. The method of claim 1, and further comprising the step of:

independently controlling the flow of pressurized liquid distributed to the air passages of the connected probes.

9. The method of claim 1, further comprising the step of:

providing an internal flow restriction and pressure drop in each of the hoses.

10. The method of claim 1, wherein the temperature of the cleaning liquid is at least 40 degrees Celsius.

11. The method of claim 10, wherein the temperature of the cleaning liquid is at least 60 degrees Celsius.

* * * * *